US006403043B1

(12) United States Patent
Utigard et al.

(10) Patent No.: US 6,403,043 B1
(45) Date of Patent: Jun. 11, 2002

(54) USE OF GASEOUS MIXTURE CONTAINING AN INERT GAS AND AN OXYGEN CONTAINING GAS IN DESULPHURIZATION OF BLISTER COPPER DURING ANODE REFINING

(75) Inventors: Torstein Utigard, Mississauga; Alejandro Bustos, Montreal, both of (CA)

(73) Assignee: L'Air Liquide Societe Anonyme a Directoire et Conseil de Surveillance pour l'Etude et l'Exploitation des Procedes Georges Claude

( * ) Notice: Subject to any disclaimer, the term of this patent is extended or adjusted under 35 U.S.C. 154(b) by 0 days.

(21) Appl. No.: 09/623,217

(22) PCT Filed: Mar. 3, 1999

(86) PCT No.: PCT/EP99/01627

§ 371 (c)(1),
(2), (4) Date: Sep. 27, 2000

(87) PCT Pub. No.: WO99/46414

PCT Pub. Date: Sep. 16, 1999

(30) Foreign Application Priority Data

Mar. 11, 1998 (CA) ..... 2231717

(51) Int. Cl.[7] ..... C01G 3/00; C22B 15/00
(52) U.S. Cl. ..... 423/47; 75/649
(58) Field of Search ..... 423/47; 75/649

(56) References Cited

U.S. PATENT DOCUMENTS 3,258,330 A 6/1966 Toshio
3,767,383 A * 10/1973 Bell et al.
4,073,646 A * 2/1978 Kryczun et al.
4,113,469 A * 9/1978 Grenfell et al.
4,451,289 A * 5/1984 Van Hecke et al.
4,469,513 A 9/1984 Staib
4,661,152 A * 4/1987 Kimura et al.
4,661,153 A * 4/1987 Sinha
4,830,667 A 5/1989 Marcuson et al.
5,180,423 A 1/1993 Marcuson et al.
6,210,463 B1 * 4/2001 George et al.

FOREIGN PATENT DOCUMENTS

WO WO 95/09250 4/1995

* cited by examiner

*Primary Examiner*—Steven Bos
(74) *Attorney, Agent, or Firm*—Burns, Doane, Swecker & Mathis, L.L.P.

(57) ABSTRACT

The invention is concerned with an improved process for the desulphurization of blister copper during anode refining, wherein a mixture of an inert gas and an oxygen containing gas is blown into liquid blister copper. The improvement resides in varying the amount of oxygen containing gas in the mixture of nitrogen and oxygen during the desulphurization of blister copper. The process of the invention enables one to increase the recovery of copper, decrease the recycling of highly oxidized slag, decrease the time of desulphurization, decrease refractory wear, decrease subsequent time of reduction and decrease the amounts of reactants used.

13 Claims, No Drawings

USE OF GASEOUS MIXTURE CONTAINING AN INERT GAS AND AN OXYGEN CONTAINING GAS IN DESULPHURIZATION OF BLISTER COPPER DURING ANODE REFINING

BACKGROUND OF THE INVENTION

1. Field of the Invention

The present invention relates to a process for the desulphurization of blister copper. More specifically, the invention is directed to an improved process of desulphurization of blister copper by introducing a mixture of an inert gas and an oxygen containing gas such as nitrogen and oxygen into liquid blister copper, and varying the amounts of oxygen or oxygen containing gas in the mixture during the process.

2. Description of the Related Art

The purpose of the fire-refining process is to lower the sulphur content of blister copper from about 0.05 to 0.005 wt. % and the oxygen content from about 0.3 to about 0.15 wt. %. Occasionally, the starting blister copper may have sulphur contents as high as 1 wt. % and extensive desulphurization is required. The first step involves the lowering of the sulphur content and it is usually called the desulphurization step. Desulphurization is then usually followed by a reduction step of the liquid copper. In most operations, the desulphurization process is carried out by blowing air into the liquid copper, forming $SO_2$ gas which leaves the liquid copper. However, thermodynamically it is not necessary to use 21 vol. % oxygen in the gas to remove the sulphur and the high oxygen content in the injected gas, usually air, causes over-oxidation of the copper. This is particularly the case where stirring is poor.

During the initial stage of desulphurization, it may be suitable to use air with 21 vol. % oxygen. Since the amount of sulphur is fairly high, the oxygen will effectively be used to remove sulphur. However, during the latter stages of desulphurization, mass transfer of sulphur limits the rate of desulphurization. During this stage, the use of porous plugs with nitrogen containing about 5 vol. % oxygen will help to increase the stirring, as well as being sufficiently oxidizing to remove sulphur. This will reduce the amount of highly oxidized slag formed. In fact, nitrogen stirring at the end of the cycle may cause some of the copper oxide to back-react with sulphur thereby significantly improving the final metallurgy.

As seen in the paper by P. Goyal et al, "Gaseous Refining of Anode Copper", Journal of Metals, December 1982, pp. 22–28, the oxygen content in blister copper increases during the desulphurization step. Thermodynamically, in order to reach a sulphur content of 0.005 wt. % S in copper at the end of the desulphurization step, an inlet oxygen pressure of about 0.05 atm is required in order to prevent $Cu_2O$ formation at unit activity. With the injection of air, thermodynamically, $Cu_2O$ starts to form at a sulphur content of about 0.005 wt. %. In real practice, copper oxide starts to form at higher sulphur contents. The work by Goyal et al showed that it was possible to lower the sulphur content in copper by the use of nitrogen only. With nitrogen injection alone, the following reaction takes place.

$$2[O]+[S]+N_2(gas)\rightarrow SO_2 \text{ in } N_2,\ P_{SO2}<<1 \text{ atm} \quad (1)$$

With the presence of nitrogen bubbles within the liquid copper, this reaction will proceed even if the equilibrium pressure of $SO_2$ is very low. Thermodynamically it is known that the mass %0 in copper increases as the sulphur is removed, as shown by T. Shibasaki, T. Shimizu and N. Oguma (Mitsubishi Metal Corporation, Naoshima) in "Analysis of Process Dynamics and Improvement of Actual Operation of Anode Furnace", Int. Symp. Injection in Process Metallurgy, TMS 1991, Ed. T. Lehner, P. J. Koros and V. Ramachandran, pp. 265–276. At the final end-point of sulphur removal, the equilibrium $SO_2$ pressure is approximately 0.05 atm. This means that to prevent over-oxidation, the final desulphurization stage should be done with a gas containing only about 5 vol. % oxygen.

The blister copper from the Mitsubishi process contains a high amount of sulphur with about 0.5 wt. % S. In order to prevent over-oxidation during desulphurization, Shibasaki et al used a mixture of steam and air instead of air only. They found that by the use of steam, the reduction time was decreased by 15 minutes and that the consumption of the reducing agent decreased by 13%. A second purpose for the use of a steam-air mixture was to decrease the tendency of tuyere plugging.

Fukunaka et al in "Desulfuirization Kinetics of Molten Copper by Gas Bubbling", Metall. Trans. B., Vol. 22B, 1991, pp. 5–11, investigated the desulphurization kinetics of molten copper by using Ar—$O_2$ mixtures with 10, 20 and 30 vol. % of oxygen. They concluded that the overall reaction is composed of two elementary reactions, namely i) the desulphurization and ii) the dissolution rate of oxygen in copper. In their experimental set-up, basically all the oxygen was consumed by the desulphurization and dissolution reactions before the bubble broke through the surface. As oxygen was injected, there was a 10 seconds time delay before any $SO_2$ evolved. This may be explained by the fact that initially the oxygen has to dissolve in the copper surrounding the gas bubbles. However, in their paper they do not mention anything about the resulting oxygen content in the copper and nothing about copper oxide formation.

In the case of Inco, S. W. Marcuson et al, "Pyrometallurgical Copper Refining", U.S. Pat. No. 4,830,667, May 16, 1989, nitrogen is injected through commercially available fused alumina porous plugs during desulphurization of semi-blister copper. The purpose of the nitrogen injection is to stir the blister, allowing the air above the bath to react with sulphur in the semi-blister.

Rigby and Lanyi, "Use of Porous Plugs in Molten Copper Production and Refining", in Advances in Refractories for the Metallurgical Industries II Ed. M. Rigaud and C. Allaire, CIM 35th Annual Meeting in Montreal, August 1996, pp. 393–403, describe the use of porous plugs in various copper making steps. Although they stated that in some smelters, gas injection through porous plugs is being conducted with nitrogen having oxygen contents ranging between 0.2–3.0 vol. %, they did neither discuss the role of oxygen in the desulphurization process, nor mention or indicate that oxygen may react with sulphur to cause desulphurization.

It has also been observed that when a nitrogen-oxygen mixture is injected into blister copper, oxygen reacts according to $$O_2(\text{in } N_2)+xS(\text{dissolved})=xSO_2(\text{in } N_2)+yO(\text{dissolved}) \quad (2)$$

This means that the pressure of $SO_2$ in the gas within the liquid copper is always less than or equal to the pressure of oxygen in the injected gas. The lower the oxygen content in the injected gas, the lower the $SO_2$ content in the gas bubbles leaving the copper during the desulphurization process. In addition, during desulphurization we have the following relationship $$[S] + 2[O] = SO_2(gas),\ K = \frac{P_{SO_2}^{(atm)}}{\%\ S \cdot \%\ [O]^2} \approx 36 \quad (3)$$

which leads to $$\%\ O_{Cu} \approx 0.167 \cdot \sqrt{\frac{P_{SO_2}^{(atm)}}{\%\ S_{Cu}}} \quad (4)$$

This equation clearly shows that as the sulphur content decreases, the amount of dissolved oxygen in liquid copper increases for constant $SO_2$ pressures. This is very important in terms of the amount of reduction which subsequently has to be done. If the sulphur is decreased to 0.003 wt. % at a $SO_2$ pressure of 0.21 atm, the dissolved oxygen is 1.39 wt. %. However, if instead the equilibrium $SO_2$ pressure had been 0.1 atm, the oxygen content would have been 0.96 wt. % and at 0.05 atm $SO_2$, the amount of dissolved oxygen in the final copper is only 0.68 wt. %. This shows clearly that i) the required amount of oxygen decreases as the $SO_2$ pressure decreases and ii) that the amount of reduction to be done also decreases. Since the $SO_2$ pressure within the bubbles is directly related to the partial pressure of $O_2$ in the inlet gas, a decrease in the inlet oxygen content will lead to less dissolved oxygen in the copper.

SUMMARY OF THE INVENTION

It is an object of the present invention to provide a process of desulphurization of blister copper which increases the recovery of copper, decreases the recycling of highly oxidized slag, decreases the time of desulphurization, decreases refractory wear, decreases subsequent time of reduction, and decreases the amounts of reactants used.

It is another object of the present invention to provide a process which improves the desulphurization of blister copper.

It is another object of the present invention to provide a process for the desulphurization of blister copper in which less over-oxidation takes place and the process is significantly improved.

It is yet another object of the present invention to provide a process of desulphurization of blister copper, with a nitrogen-oxygen containing gas of controlled and variable amounts of oxygen.

The invention relates to a process of desulphurization of blister copper during anode refining wherein a mixture of an inert gas and an oxygen containing gas is blown into liquid blister copper. The process is characterized by varying the amount of oxygen containing gas in the mixture during the desulphurization of blister copper. In practice, the inert gas is nitrogen, although carbon dioxide or argon and the like can also be used. The preferred inert gas is of course nitrogen. The oxygen containing gas may comprise oxygen per se or air. The usual mixture comprises nitrogen and air.

Preferably, the amount of oxygen the mixture is varied is about 21 to about 4 vol. %.

For example, the amount of oxygen in the mixture at the start of the desulphurization process may be set at about 21 vol. %, this amount being reduced to about 4 vol. % at the end of the desulphurization process.

Air is preferably used at the start of the desulphurization process. After an initial treatment with air, the desulfurization may be switched to a treatment with separate sources of nitrogen and oxygen wherein the amount of oxygen in the mixture is gradually decreased.

Decreasing the amount of oxygen relative to nitrogen may be provided by separately feeding from a liquid nitrogen tank and a liquid oxygen tank. Decreasing of the above amount may be carried step by step.

According to a preferred embodiment, at the end of the desulphurization process, porous plugs containing a mixture of nitrogen and oxygen wherein oxygen accounts for about 5 weight percent of the mixture, are introduced into the liquid blister copper, the plugs being handled to stir the liquid blister copper.

It has been found that the use of nitrogen-oxygen mixtures with oxygen contents varying for example from 21 to about 4 vol. %, instead of air, will improve the desulphurization of blister copper. Thermodynamically it is not necessary to use 21 vol. % oxygen in the gas to remove sulphur. The high oxygen content together with poor mixing in the vessel cause over-oxidation to take place. By using nitrogen with about 5 vol. % oxygen, less over-oxidation takes place and the process improves significantly. In particular, if such a gas mixture is used together with porous plugs, a much improved blister copper refining process will result.

The advantages of using such a varying amount of oxygen in the injected gas include 1) increased recovery of copper,
2) decreased recycling of highly oxidized slag,
3) decreased time of desulphurization,
4) decreased refractory wear
5) decreased subsequent time of reduction, and
6) decreased amount of reductants used.

It has also been realized that by using nitrogen with controlled amounts of oxygen during the desulphurization of blister copper during anode refining, the desulphurization process can be made more efficient in terms of i) decreasing the degree of over-oxidation of the copper, ii) increasing the recovery of copper during the desulphurization process, iii) reducing the requirement of de-oxidation, iv) shorter cycle time and v) reduced refractory corrosion. This will lead to increased productivity and improved profitability.

The invention is illustrated but is not limited by the following example.

EXAMPLE 1

Table 1 shows the effect of using various oxygen pressures in the inlet gas on the $SO_2$ pressure generated within the copper, the final oxygen content in the copper and the total amount of $N_2$—$O_2$ used. since one mole of $O_2$ can form up to one mole of $SO_2$, the maximum pressure of $SO_2$ in the gas within the liquid copper equals the pressure of $O_2$ in the injected gas.

Table 1

Oxygen requirement for lowering of the sulphur content of 100 tons of copper from 0.3 to 0.003 wt. % S. If the initial copper is in equilibrium with $SO_2$ at 0.21 ATM, the copper will initially contain 0.14 wt. % O which is equivalent to 4,400 moles of $O_2$. Stoichiometrically, to remove the sulphur only, 9,400 moles of $O_2$ are required.

| $SO_2$ (atm) | Final wt. % O in Cu | Final mol O in Cu | Total mol $O_2$ required | Total $Nm^3$ of $N_2$—$O_2$ |
|---|---|---|---|---|
| 0.21 | 1.4 | 88,000 | 49,000 | 5,650 |
| 0.15 | 1.18 | 74,000 | 42,000 | 6,780 |
| 0.10 | 0.96 | 60,000 | 35,000 | 8,470 |
| 0.075 | 0.84 | 52,000 | 31,000 | 10,000 |
| 0.05 | 0.68 | 42,000 | 26,000 | 12,600 |
| 0.025 | 0.37 | 23,200 | 16,600 | 16,000 |

The fraction of the oxygen reacting with sulphur to form $SO_2$ over the total amount of oxygen used, decreases as the sulphur content decreases. It is interesting to note that at high $SO_2$ pressures, more oxygen is used to increase the oxygen content of the copper than that used to remove sulphur. It must be noted that the actual amount of gas required is expected to be lower due to reactions with oxygen in the air above the bath surface. An important observation is that with a $SO_2$ pressure of 0.05 atm, the amount of dissolved oxygen in the copper is only about half that at 0.21 atm $SO_2$. This means that the reduction step can significantly be shortened and the amount of reductant used, decreased.

All in all, it has been found that by injecting nitrogen with various amounts of oxygen into liquid blister copper, the desulphurization of blister copper can be carried out with much less oxidation of the copper. Furthermore, the desulphurization of blister copper can be carried out in such a way that the following reduction step can be shortened and the total gas flowrate can be increased leading to shortened desulphurization time and increased productivity. Finally, according to the invention, the refining of metals can be carried out more efficiently.

What is claimed is:

1. In the process of desulphurization of blister copper during anode refining wherein a mixture of an inert gas and an oxygen containing gas is blown into liquid blister copper, the improvement which comprises varying the amount of oxygen containing gas in said mixture of nitrogen and oxygen during said desulphurization of blister copper.

2. Process according to claim 1, wherein said inert gas is selected from the group consisting of nitrogen, carbon dioxide and argon.

3. Process according to claim 2, wherein said inert gas comprises nitrogen.

4. Process according to claim 1, wherein said oxygen containing gas comprises air.

5. Process according to claim 1, wherein said mixture comprises nitrogen and oxygen.

6. Process according to claim 1, wherein the amount of oxygen in said mixture is varied from about 21 to about 4 vol. %.

7. Process according to claim 1, wherein the amount of oxygen in said mixture at the start of the desulphurization process is set at about 21 vol. %, said amount being reduced to about 4 vol. % at the end of the desulphurization process.

8. Process according to claim 1, wherein air is used at the start of the desulphurization process.

9. Process according to claim 8, wherein after said initial introduction of air, separate sources of inert gas and oxygen are introduced wherein the amount of oxygen in said mixture is decreased to about 4 vol. %.

10. Process according to claim 9, wherein the mixture with a decreasing amount of oxygen relative to inert gas is provided by separately feeding from a liquid inert gas tank and a liquid oxygen tank.

11. Process according to claim 10, wherein the decrease in the amount of oxygen is gradual.

12. Process according to claim 7, wherein at the end of the desulphurization process porous plugs are introduced into said liquid blister copper to stir said liquid blister copper, the plugs providing a mixture of inert gas and oxygen wherein the oxygen comprises about 5 vol. % of the mixture.

13. Process according to claim 8, wherein at the end of the desulphurization process porous plugs are introduced into said liquid blister copper, to stir said liquid blister copper, the plugs containing a mixture of inert gas and oxygen wherein the oxygen comprises about 5 vol. % of the mixture.

* * * * *